US006430890B1

(12) United States Patent
Chiwhane et al.

(10) Patent No.: US 6,430,890 B1
(45) Date of Patent: Aug. 13, 2002

(54) WEB STIFFENER

(75) Inventors: Naresh Chiwhane, Highland; Larry R. Daudet, Porter, both of IN (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/537,069

(22) Filed: Mar. 28, 2000

(51) Int. Cl.[7] ..... E04B 1/38

(52) U.S. Cl. ..... 52/715; 52/655.1; 52/665; 52/702; 52/736.2; 52/737.2; 52/739.1

(58) Field of Search ..... 52/702, 712, 715, 52/739.1, 650.3, 665, 464, 655.1, 737.2, 736.2

(56) References Cited

U.S. PATENT DOCUMENTS

| | | | | |
|---|---|---|---|---|
| 813,253 | A | | 2/1906 | Sullivan |
| 1,360,720 | A | | 11/1920 | Brown et al. |
| 1,664,499 | A | | 4/1928 | Baker |
| 1,765,107 | A | | 6/1930 | Snyder |
| 2,321,221 | A | | 6/1943 | Linehan |
| 2,392,674 | A | | 1/1946 | Lachman et al. |
| 2,413,362 | A | | 12/1946 | Maxwell et al. |
| 2,704,868 | A | | 3/1955 | Danielson |
| 3,184,800 | A | | 5/1965 | Nelson |
| 3,188,696 | A | * | 6/1965 | Earhart |
| 3,216,160 | A | | 11/1965 | Best |
| 3,537,221 | A | | 11/1970 | Helfman et al. |
| 3,615,110 | A | | 10/1971 | Fugate |
| 3,717,964 | A | | 2/1973 | Brown et al. |
| 3,751,870 | A | | 8/1973 | Vesei |
| 3,798,865 | A | | 3/1974 | Curtis |
| 3,902,298 | A | | 9/1975 | Ratliff, Jr. |
| 3,907,445 | A | | 9/1975 | Wendt |
| 3,945,741 | A | | 3/1976 | Wendt |
| 3,973,302 | A | | 8/1976 | Semmerling |
| 4,047,348 | A | | 9/1977 | McSweeney |
| 4,123,887 | A | | 11/1978 | Weinar |
| 4,129,974 | A | | 12/1978 | Ojalvo |
| 4,196,556 | A | * | 4/1980 | Russo ..... 52/714 |
| 4,385,476 | A | | 5/1983 | Slager |
| 4,464,074 | A | | 8/1984 | Green et al. |
| 4,517,776 | A | | 5/1985 | Barker |
| 4,616,453 | A | | 10/1986 | Sheppard, Jr. et al. |
| 4,688,358 | A | | 8/1987 | Madray |

(List continued on next page.)

FOREIGN PATENT DOCUMENTS

| | | |
|---|---|---|
| CA | 1168827 | 6/1984 |
| CA | 1207192 | 7/1986 |
| CA | 1228709 | 11/1987 |
| CA | 1287960 | 8/1991 |
| CA | 1306093 | 8/1992 |
| CA | 2009252 | 9/1993 |
| CA | 2106801 | 6/1994 |
| CA | 2006055 | 3/1999 |
| SE | 238822 | 9/1986 |

OTHER PUBLICATIONS

*Residential Steel Framing Construction Guide* by E.N. Lorre, 1993 Aegean Park Press, pp. A.9, A.14, A.17, E.8, and checklist.

(List continued on next page.)

*Primary Examiner*—Carl D. Friedman
*Assistant Examiner*—Yvonne M. Horton
(74) *Attorney, Agent, or Firm*—Kirkpatrick & Lockhart LLP

(57) ABSTRACT

A web stiffener for use with a building component having a web portion and a leg portion that extends generally outwardly from the web portion, the leg portion having a lip that extends generally upwardly therefrom. The web stiffener includes a first member and a second member extending generally outwardly from the first member, wherein the second member defines a slot to receive the lip of the building component. An assembly that utilizes the web stiffener and method of attaching the first building component and a second building component utilizing the web stiffener are also disclosed.

32 Claims, 6 Drawing Sheets

U.S. PATENT DOCUMENTS

| | | | | | |
|---|---|---|---|---|---|
| 4,893,961 | A | | 1/1990 | O'Sullivan et al. | |
| 4,932,173 | A | | 6/1990 | Commins | |
| 5,109,646 | A | | 5/1992 | Colonias et al. | |
| 5,186,571 | A | | 2/1993 | Hentzschel | |
| 5,625,995 | A | | 5/1997 | Martin | |
| 5,715,642 | A | | 2/1998 | Buers | |
| 6,088,982 | A | * | 7/2000 | Hiesberger | 52/241 |

OTHER PUBLICATIONS

*Delta Metal Products, Inc.*, DMP–9409, Jun. 1994, pp. Table of Contents, B.8, C.5., and F. 13.

*Prescriptive Method for Residential Cold–Formed Steel Framing*, Second Edition, Sep. 1997, pp. 25 and 28.

Simpson Strong–Tie Company, Inc. Price Book, P–97–1, 1997, p. 16.

Dietrich Industries, Inc. "Curtain Wall/Light Gage Structural Framing Products" ICBO No. 4784P—LA RR No. 25132, 1995, p. 3.

*Dale/Incor*, Steel Framing Systems, 00540/DAL, 1989, Deflection Systems, p. 9.

*Unimast Incorporated*, Steel Framing Systems, 1991, "Curtain Wall Slip Track and Curtain Wall Slide Clip," p. 28.

*Dietrich Industries, Inc.*, 39/90 Dietrich—LGSF Details, 1994, Slide Clip/Vertical Slide Clip Application, p. 3.

* cited by examiner

WEB STIFFENER

CROSS-REFERENCE TO RELATED APPLICATIONS

Not applicable.

FEDERALLY SPONSORED RESEARCH

Not applicable.

BACKGROUND OF THE INVENTION

1. Field of the Invention

The invention relates to building materials and, more particularly, to a web stiffener for stiffening a building component and/or attaching the building component to an additional building component.

2. Description of the Invention Background

A web stiffener is a known apparatus used to stiffen or strengthen a building component such as, for example, a joist or a beam, constructed of, for example, a metal material. Such building components are designed primarily to carry loads applied continuously along their lengths. As a result, the described building components may be susceptible to failure or crippling when required to carry more concentrated loads. The web stiffener, therefore, may be used in association with these building components to stiffen the building components and increase the strength thereof. Examples of known web stiffeners are set forth in U.S. Pat. Nos. 5,625,995 and 4,385,476.

It is also known to use a web stiffener to attach or secure a building component being stiffened to an additional building component. For example, referenced U.S. Pat. No. 5,625,995 discloses a web stiffener that includes a back plate attachable to a joist and a laterally extending base plate that is attachable to a girder. The base plate has a generally planar surface which, therefore, limits use of the web stiffener to building components that have a configuration or structure that is complimentary to the base plate.

There remains, therefore, a need for an improved web stiffener that overcomes limitations, shortcomings and disadvantages of known web stiffeners.

SUMMARY OF THE INVENTION

The invention meets the identified need, as will be more fully understood following a review of this specification and drawings.

One embodiment of the invention includes a web stiffener for use with a building component having a web portion and a leg portion that extends generally outwardly from the web portion, the leg portion having a lip that extends generally upwardly therefrom. In this embodiment, the web stiffener includes a first member and a second member extending generally outwardly from the first member, wherein the second member defines a slot to receive the lip of the building component.

Another embodiment of the invention includes an assembly comprising a first building component having a web portion and a leg portion that extends generally outwardly from the web portion, the leg portion having a lip that extends generally upwardly therefrom. The assembly also includes a web stiffener having a first member positionable adjacent the web portion of the first building component. The web stiffener also includes a second member extending generally outwardly from the first member, wherein the second member defines a slot to receive the generally upwardly extending lip of the first building component.

Yet another embodiment of the invention includes an assembly comprising a first joist, a second joist and a web stiffener. The first joist includes an inner web portion, an outer web portion and a leg portion that extends generally outwardly from the inner web portion, wherein the leg portion includes a lip that extends generally upwardly therefrom. The second joist includes an inner web portion, an outer web portion and a leg portion that extends generally outwardly from the inner web portion. The outer web portion of the first joist is positionable adjacent the outer web portion of the second joist. The web stiffener comprises a first member positionable adjacent the inner web portion of the first joist and a second member extending generally outwardly from the first member, wherein the second member defines a slot to receive the lip of the first joist.

The invention also includes a method of attaching a first building component and a second building component, where the first building component includes a web portion and a leg portion that extends generally outwardly from the web portion. The leg portion of the first building component includes a lip that extends generally upwardly therefrom. The method includes providing a web stiffener having a first member and a second member, the second member extending generally outwardly from the first member and defining a slot. The method also includes positioning the first member adjacent a web portion of the first building component. The method further includes positioning the second member adjacent the leg portion of the first building component and adjacent the second building component such that the lip extending generally upward from the leg portion of the first building component is received in the slot. The method also includes attaching the first member to the first building component, and attaching the second member to the first building component and the second building component.

BRIEF DESCRIPTION OF THE DRAWINGS

In the accompanying drawings, like reference numbers are employed to designate like parts.

DETAILED DESCRIPTION OF THE INVENTION

Figure 1:
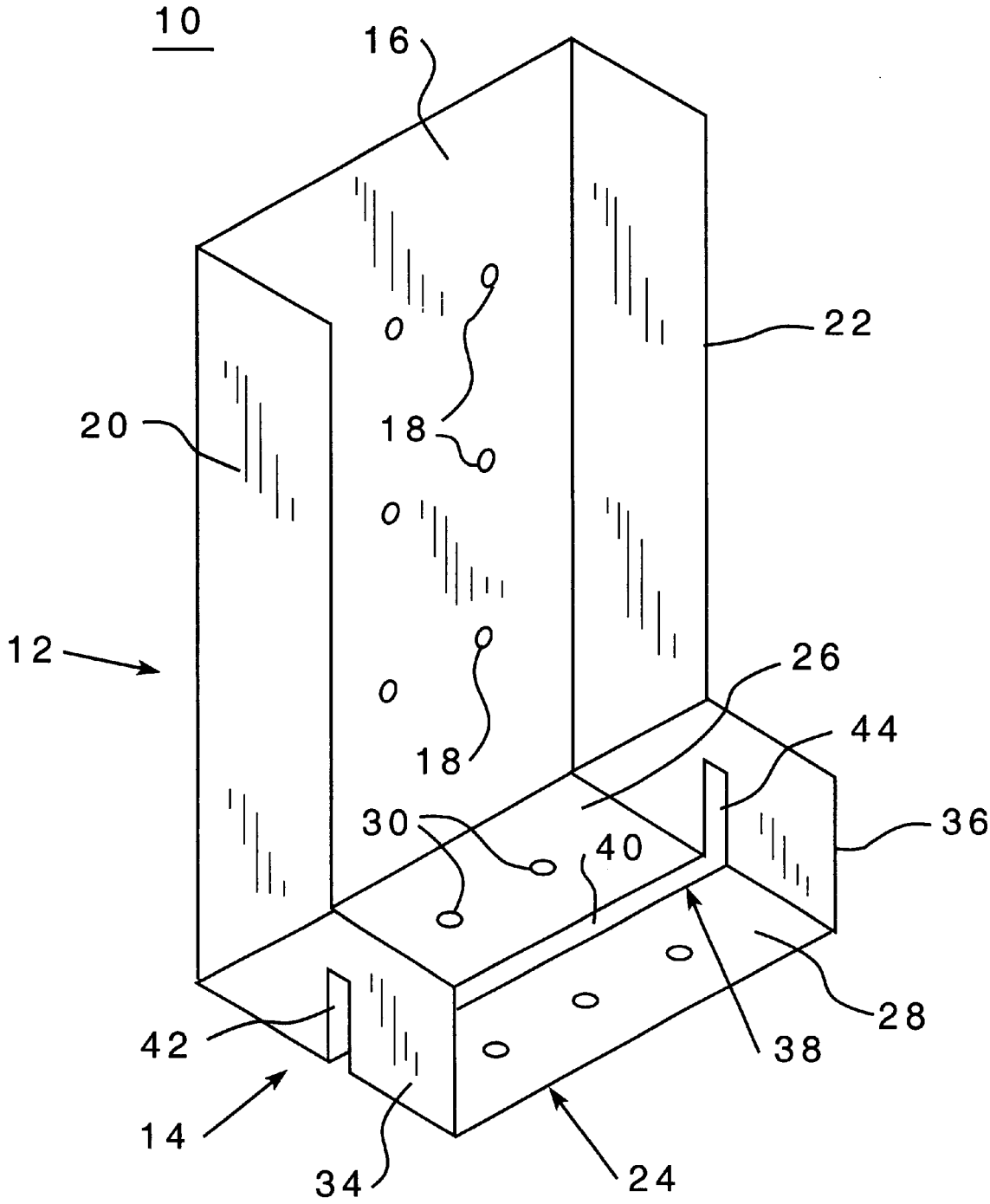
FIG. 1 is an isometric view of a web stiffener of the invention.

Referring now to the drawings for the purposes of illustrating the invention only and not for purposes of limiting the same, there is shown a web stiffener 10 of the invention for use with building components, such as, for example, joists, beams, etc. Generally, the web stiffener 10 may be used with any building component having a web portion and a leg portion that extends generally outwardly from the web portion, wherein the leg portion has a lip that extends generally upwardly therefrom, as will be described in more detail herein. Such a building component may include, for example, a joist or beam having a generally C-shaped cross-section, as will also be described in more detail herein. In addition, it will be appreciated that characterizations of various components that will be described herein as extending, for example, upwardly or downwardly, are relative characterizations only based upon the particular position or orientation of a given component for a particular application.

Referring to FIGS. 1–4, there is shown one embodiment of the web stiffener 10 of the invention. Referring specifically to FIG. 1, the web stiffener 10 will be described in detail. The web stiffener 10 includes a first member, generally designated by reference number 12, and a second member, generally designated by reference number 14. The first member 12 includes a web plate 16 having, preferably, a generally planar surface. The web plate 16 may have a plurality of apertures 18 extending therethrough for purposes of attaching the web stiffener 10 to a building component, as will be described in more detail herein.

The first member 12 of the web stiffener 10 also includes a first web support element 20 extending from a first side of the web plate 16 and a second web support element 22 extending from a second side of the web plate 16. The first web support element 20 and the second web support element 22 may extend generally perpendicularly from the planar surface of the web plate 16. In addition, the first web support element 20 and the second web support element 22 may also have generally planar surfaces. It will be appreciated that the web support elements 20, 22, or additional web support elements (not shown), may be positioned along the width of the web plate 16.

Still referring to FIG. 1, the second member 14 of the web stiffener 10 includes a base plate, generally designated by reference number 24, having an inner base portion 26 and outer base portion 28. The inner base portion 26 and the outer base portion 28 may both include generally planar surfaces that may each have a plurality of apertures 30 and 32, respectively, extending therethrough.

The second member 14 of the web stiffener 10 also includes a first base support element 34 extending generally upwardly from the base plate 24 and a second base support element 36 also extending generally upwardly from the base plate 24. As illustrated, the first base support element 34 may extend generally perpendicularly from the base plate 24 and be attached to a first end of the inner base portion 26 and a first end of the outer base portion 28. Similarly, the second base support element 36 may extend generally perpendicularly from the base plate 24 and be attached to a second end of the inner base portion 26 and a second end of the outer base portion 28. Both the first base support element 34 and the second base support element 36 may have generally planar surfaces.

Still referring to FIG. 1, the second member 14 of the web stiffener 10 defines a slot, generally designated by reference number 38. Specifically, the inner base portion 26 and outer base portion 28 of the base plate 24 define an elongated portion 40 of the slot 38. In addition, the first base support element 34 defines a first portion 42 of the slot 38 and the second base support element 36 defines a second portion 44 of the slot 38. Accordingly, it will be appreciated that the elongated portion 40, the first portion 42 and the second portion 44 cooperate to form the slot 38 as a "continuous" slot formed in the second member 14 of the web stiffener 10. It will be appreciated, however, that the slot 38 may be configured and arranged accordingly, in accordance with the invention, depending on the particular use and application of the web stiffener 10. It will also be appreciated that the base support elements 34, 36, or other base support elements (not shown), may be positioned along the width of the base plate 24 with the slot positioned accordingly.

The web stiffener 10 may be fabricated from a single piece of material and be fabricated from a metal such as cold rolled steel, hot rolled steel, stainless steel, aluminum or other metal composite materials.

Figure 2:
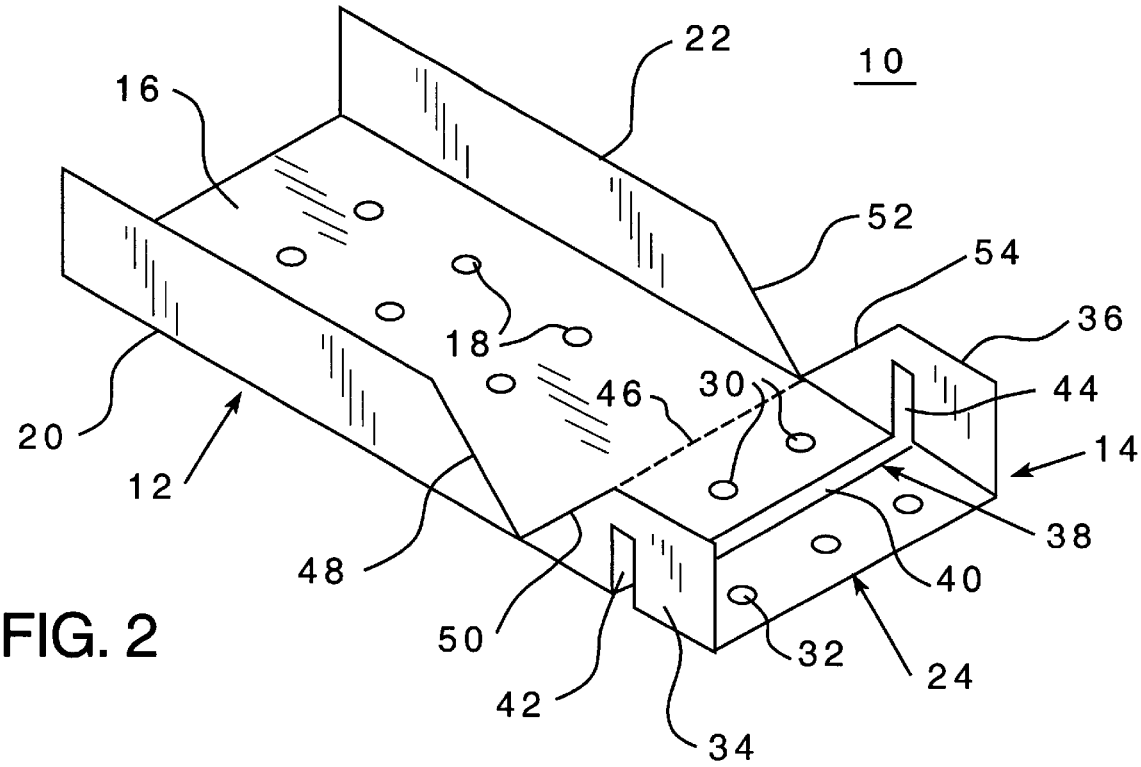
FIG. 2 is an isometric view of the web stiffener illustrated in FIG. 1 prior to final formation of the web stiffener.

As shown in FIG. 2, the web stiffener may be fabricated such that the first member 12 and the second member 14 are integrally formed with a score line 46 stamped or punched into the material to enable bending along the score line 46 to place the web stiffener in its final form, as shown in FIG. 1.

As shown in FIGS. 1 and 2, the first web support element 20 and the first base support element 34 are generally aligned. This enables a proximate end 48 of the first web support element 20 to be in engagement with and/or attached to a proximate end 50 of the first base support element 34. Similarly, the second web support element 22 is generally aligned with the second base support element 36 to enable a proximate end 52 of the second web support element 22 to be in engagement with and/or attached to a proximate end 54 of the second base support element 36. Advantageously, this configuration increases the overall rigidity and strength of the web stiffener 10.

Figure 2A:
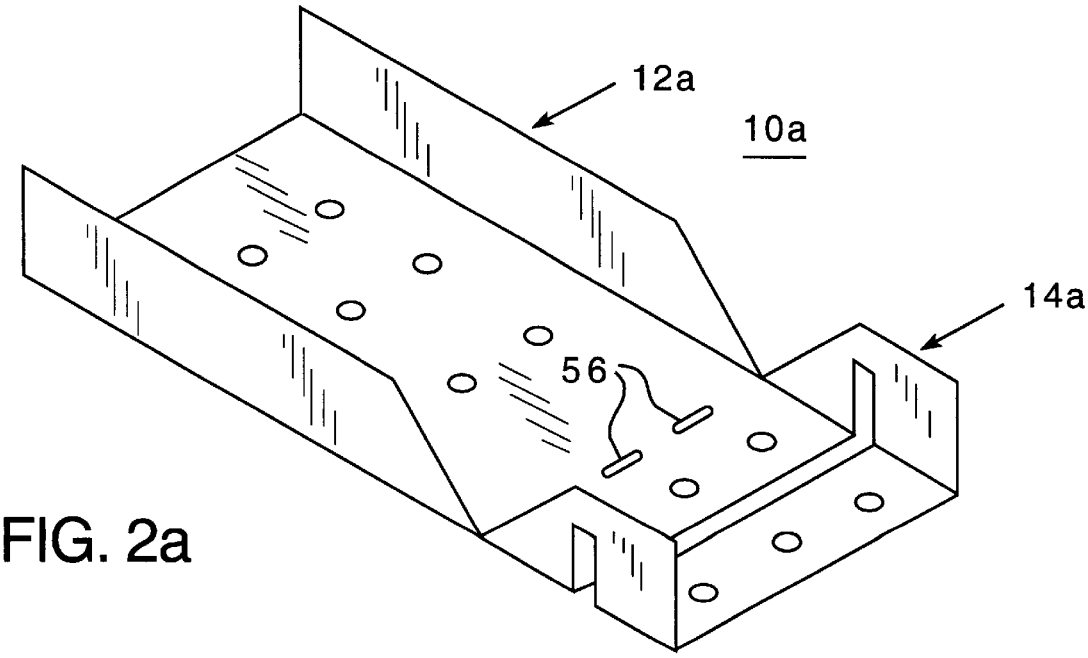
FIG. 2*a* is an isometric view illustrating another embodiment, similar to FIG. 2, prior to final formation of the web stiffener.

Referring to FIG. 2*a*, there is shown another embodiment of a web stiffener 10*a*. In this embodiment, one or more oval slugs 56 may be stamped or punched where the first member 12*a* meets the second member 14*a*. This further enables bending between the first member 12*a* and the second member 14*a* in order to place the web stiffener 10*a* in its final configuration.

Figure 3:
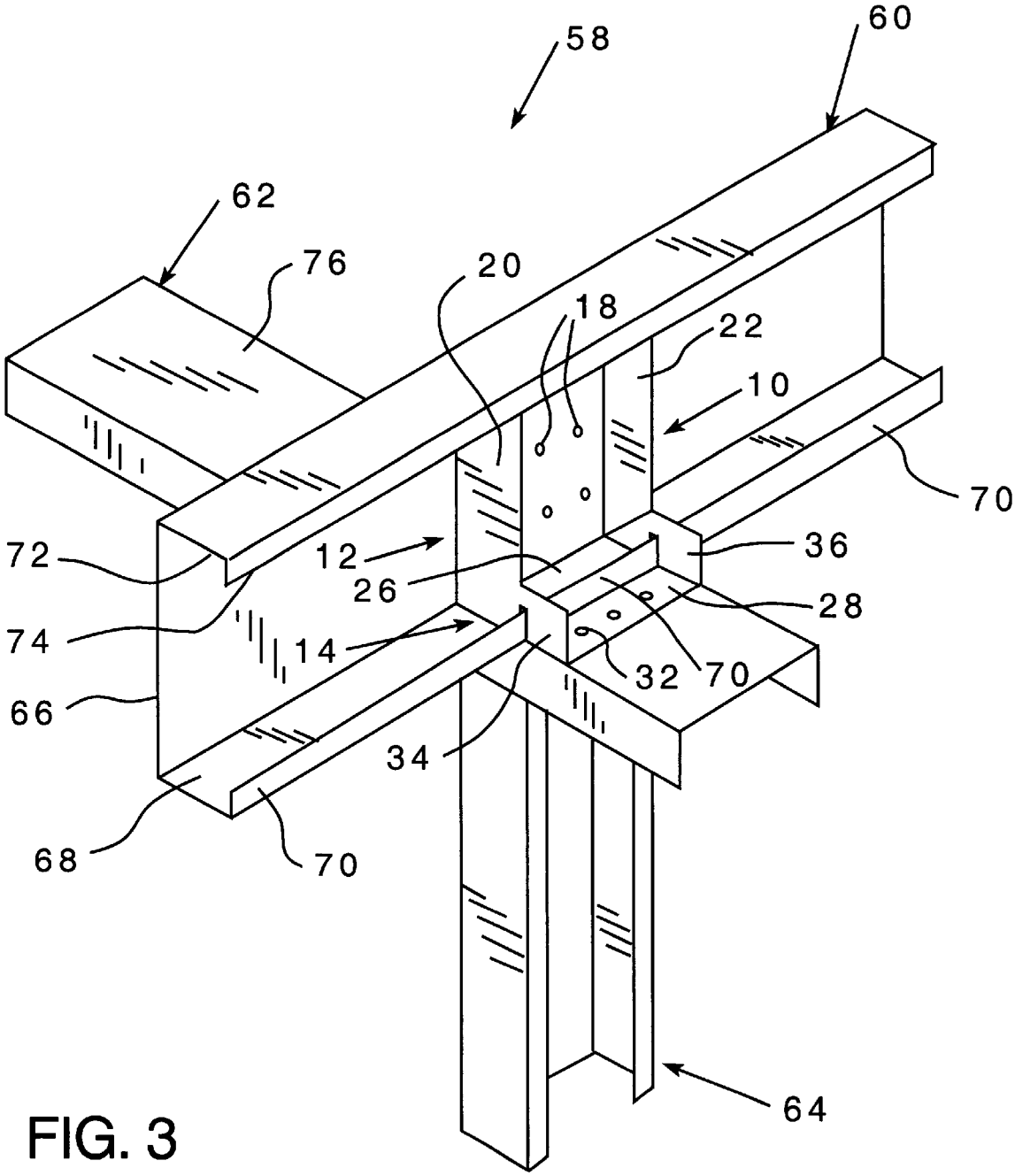
FIG. 3 is an isometric view of an assembly of the invention illustrating use of the web stiffener, shown in FIG. 1, with building components.
Figure 4:
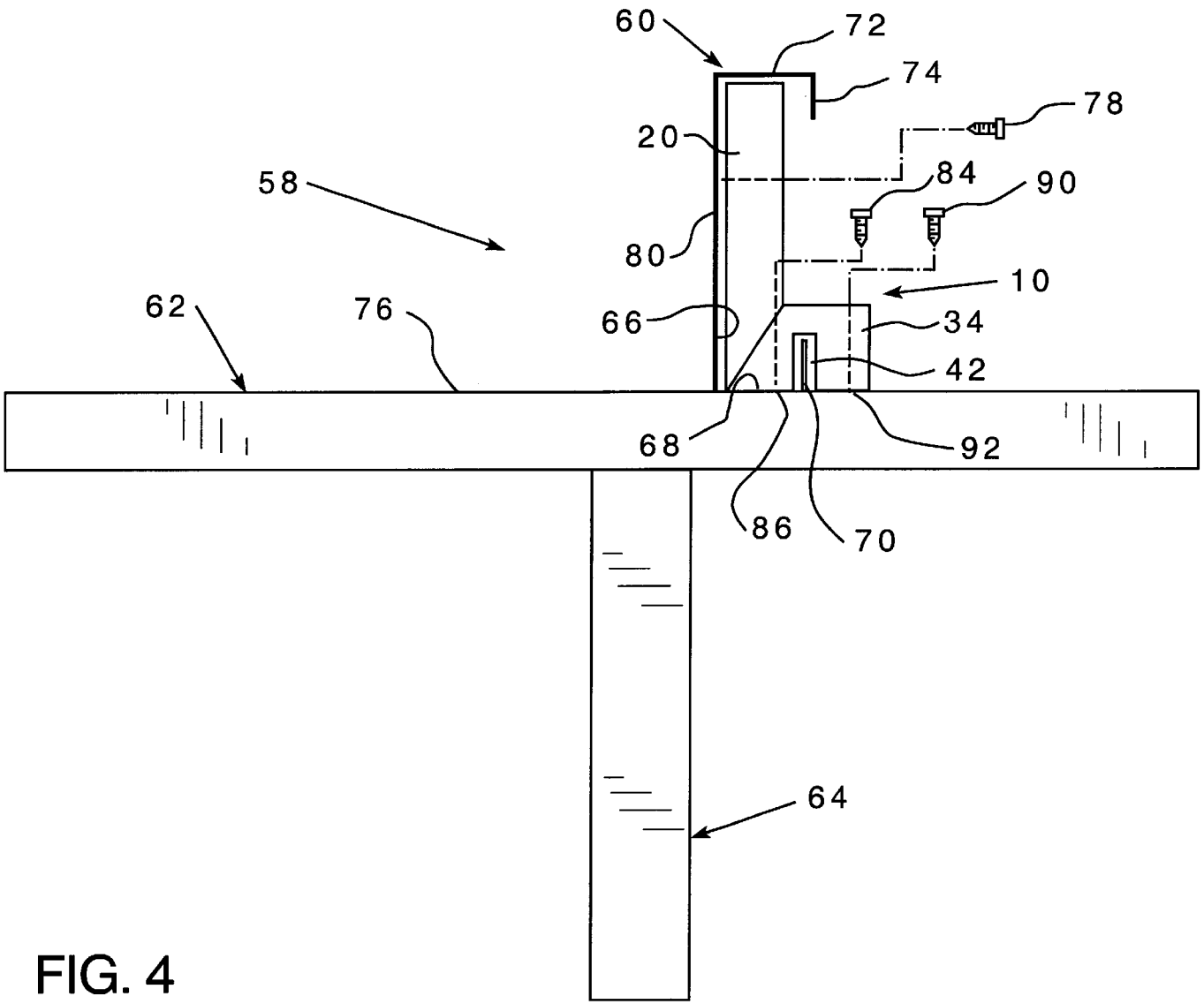
FIG. 4 is a side elevational view of the assembly illustrated in FIG. 3.

Referring to FIGS. 3 and 4, there is illustrated an example of an assembly, generally designated by reference number 58, which may utilize the web stiffener 10 of the invention. The assembly 58 includes a first building component, such as, for example, joist 60 (also referred to herein as a first joist) and a second building component, such as, for example, girder 62 that may be used in conjunction with, for example, a typical wall stud 64. The joist 60, the girder 62 and the wall stud 64 are all known components which may be fabricated, for example, from a metal such as cold rolled steel, hot rolled steel, stainless steel, aluminum or other metal composite materials.

The joist 60 is shown in FIGS. 3 and 4 as having a generally C-shaped cross-section. Specifically, joist 60 includes a web portion 66 and a leg portion 68 that extends generally outwardly from the web portion 66. The joist 60 also includes a lip 70 that extends generally upwardly from the leg portion 68. The joist 60 also includes an additional leg portion 72 that extends generally outwardly from the web portion 66 and an additional lip 74 that extends generally downwardly from the additional leg portion 72. While the joist 60, as described, has a generally C-shaped cross-section, it will be appreciated by those of ordinary skill in the art that the additional leg portion 72 and corresponding additional lip 74 are not necessary for practicing the invention utilizing the web stiffener 10. It will also be appreciated that the present invention could also be successfully employed with joists or other building components that have, for example, a Z-shaped cross section.

The assembly 58 includes the girder 62 being mounted to the wall stud 64, in a manner as is generally known in the art. In addition, the joist 60 is positioned for mounting on an upper surface 76 of the girder 62. The web stiffener 10 is then positioned, relative to the joist 60, in order to provide stiffening and increased strength for the joist 60 and/or to provide stiffening and a component to attach the joist 60 to the girder 62. Although the web stiffener 10 is illustrated in FIG. 4 as not in direct engagement with the additional leg 72 of the joist 60, it will be appreciated that the web stiffener 10 may be sized to initially contact the leg (however, as described, it is not necessary that the joist 60 or other building component include the additional leg 72 and lip 74 to practice the invention).

Specifically, the first member 12 is positioned adjacent the web portion 66 of the joist 60. Preferably, the web plate 16 of the first member 12 is contiguous with the web portion 66 of the joist 60. One or more fasteners, such as, for example, screw 78 (see FIG. 4) may be received in aperture 18 and an aligned aperture 80 formed in the web portion 66. A plurality of such fastening arrangements may be provided to securely attach the web stiffener 10 to the joist 60

In addition, the base plate 24 of the web stiffener 10 is positioned such that the lip 70 of the joist 60 is received in the slot 38, as defined by the second member 14 of the web stiffener 10. Preferably, the inner base 26 of the base plate 24 is contiguous with the leg portion 68 of the joist 60, while the outer base 28 of the base plate 24 is contiguous with the upper surface 76 of the girder 62. A fastener, such as screw 84, may be received in one of the apertures 30 defined by the inner base 26 and an aligned aperture 86 defined by the upper surface 76 of the girder 62. One or more such fastening arrangements may be provided for securely attaching the web stiffener 10 to the joist 60 and the girder 62. Also, a fastener, such as screw 90, may be received in one of the apertures 32 defined by the outer base portion 28 and an aligned aperture 92 defined by the upper surface 76 of the girder 62 to securely attach the web stiffener 10 to the girder 62. It will be appreciated that the web stiffener 10 provides an effective component for stiffening and strengthening the first joist 60, as well as the second joist 160. Although not shown, one or more web stiffeners 10 may also be received in the web portion 166 of the second joist 160 for additional strengthening thereof.

Accordingly, it will be appreciated that the web stiffener 10 provides an effective component for stiffening and strengthening the joist 60, as well as for securely attaching the joist 60 to the girder 62. Furthermore, the slot 38 defined by the second member 14 allows for the stiffening and strengthening of the joist 60 and the attaching of the joist 60 to the girder 62 for a joist 60 having the described structure, specifically the upwardly extending lip 70.

Figure 4A:
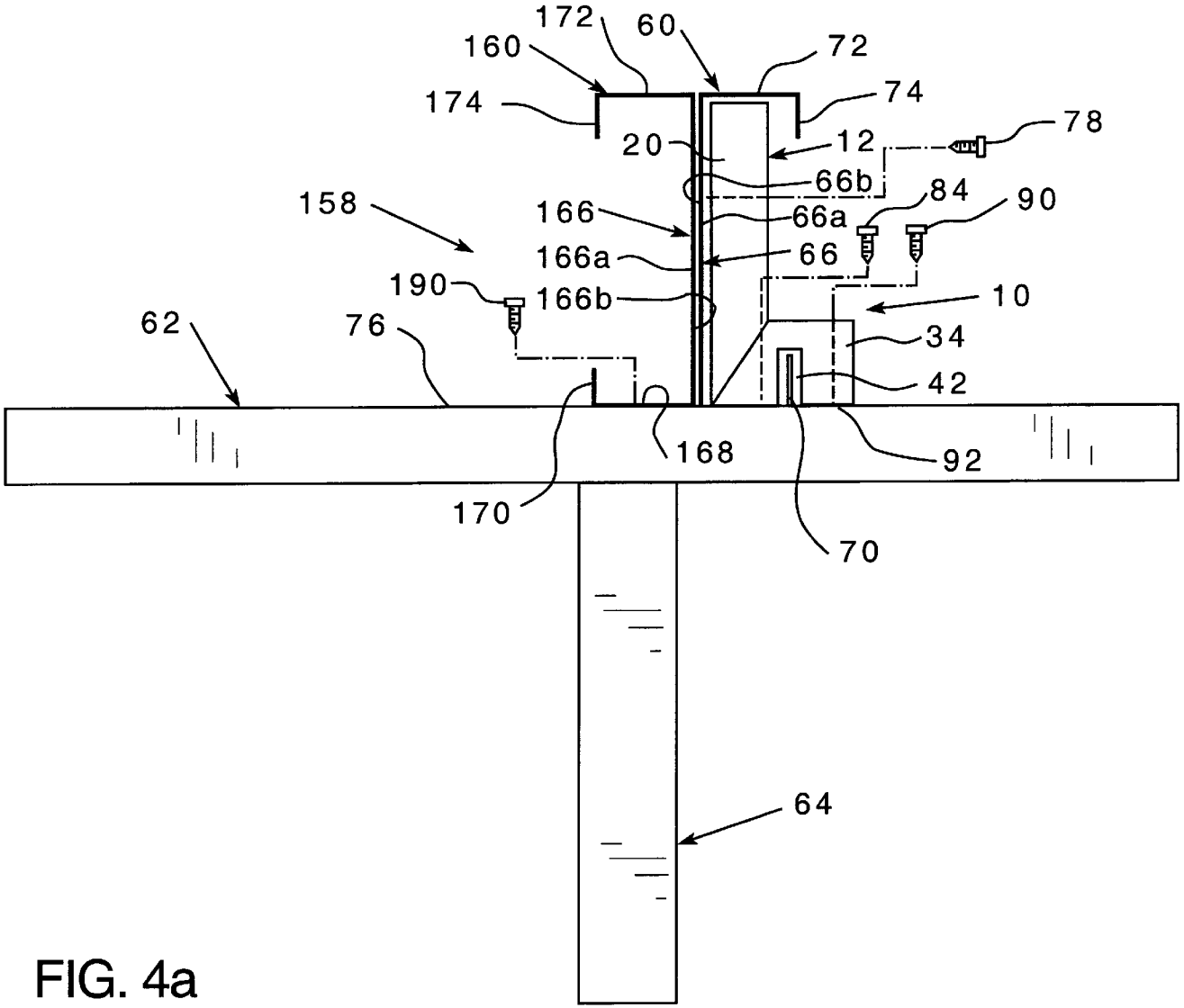
FIG. 4*a* is a side elevational view, similar to FIG. 4, illustrating another embodiment of an assembly of the invention.

Referring to FIG. 4*a*, there is shown another assembly 158 of the invention that is similar to the assembly 58 illustrated in FIG. 4. Specifically, a second joist 160 having a web portion 166 with an inner web portion 166*a* and an outer web portion 166*b* is positioned adjacent an outer web portion 66*b* of the first joist 60. The first joist 60 also includes an inner web portion 66*a*. In this arrangement, the first member 12 of the web stiffener 10 is positionable adjacent the inner web portion 66*a* of the first joist 60. One or more fasteners, such as, for example, screw 78 may be received in aperture 18 and aligned apertures formed in the web portions 66 and 166 of the first joist 60 and the second joist 160, respectively. A plurality of such fastening arrangements may be provided to securely attach the web stiffener 10 to the first joist 60 and the second joist 160. In addition, a fastener, such as screw 190, may be received in an aperture formed in a leg portion 168 of the second joist 160 to securely attach the second joist 160 to the upper surface 76 of the girder 62.

While the second joist 160 is shown as having leg 168 with lip 170 and leg 172 with lip 174, it will be appreciated that the second joist may have other configurations in accordance with the invention. It will also be appreciated that in the assembly 158 the web stiffener 10 provides an effective component for stiffening and strengthening both joist 60 and joist 160. One or more web stiffener 10 could be placed in the web 166 of joist 160 to attach the joist 160 to joist 60 as well.

Figure 5:
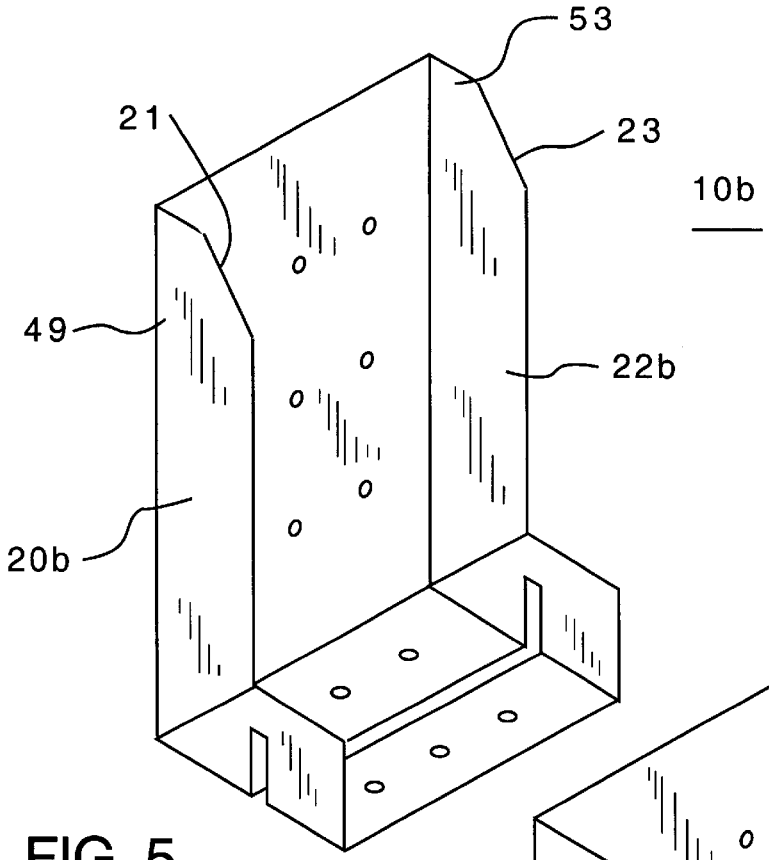
FIG. 5 is another embodiment of the web stiffener of the invention.

Referring to FIG. 5, there is shown another embodiment of a web stiffener 10*b* of the invention. In this embodiment, the first web support element 20*b* includes a beveled end 21 formed on a distal end 49 thereof. Similarly, the second web support element 22*b* includes a beveled end 22 formed on a distal end 53 thereof. The beveled ends 21 and 23 allow for easier placement of the web stiffener 10*c* adjacent the web portion 66 of the joist 60, particularly for the described configuration where the joist 60 includes the additional leg portion 72 and additional lip 74.

Figure 6:
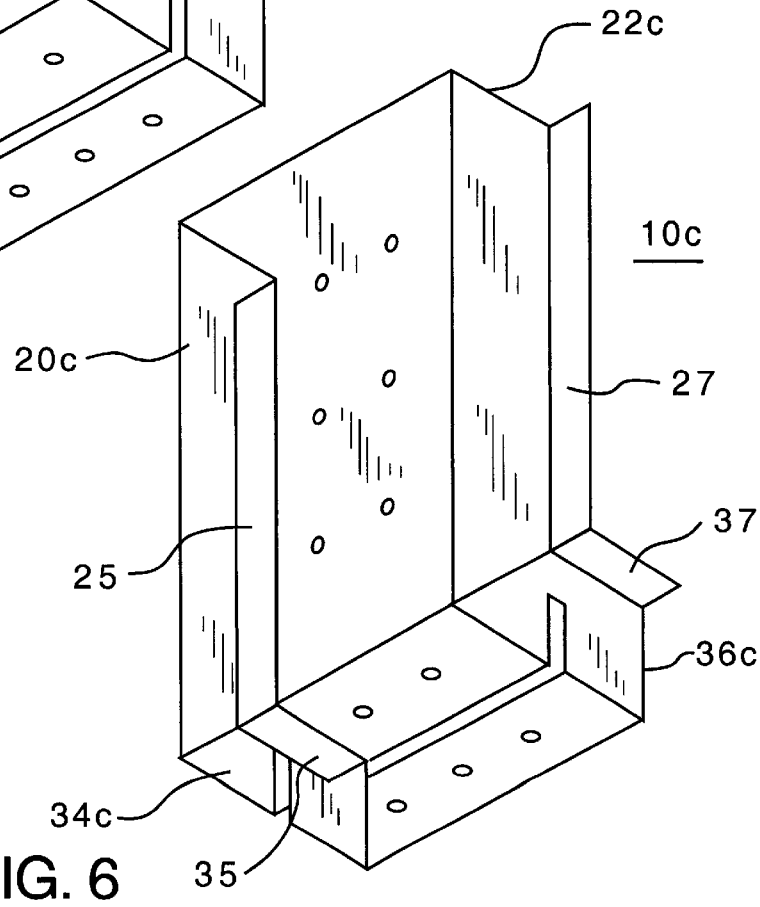
FIG. 6 is yet another embodiment of the web stiffener of the invention.

Referring to FIG. 6, there is shown another embodiment of a web stiffener 10*c* of the invention. In this embodiment, the first web support element 20*c* and the second web support element 22*c* each include an outwardly extending lip 25 and 27, respectively. Similarly, the first base support element 34*c* and the second base support element 36*c* each include an outwardly extending lip 35 and 37, respectively. It will be appreciated by those of skill in the art that the outwardly extending lips 25, 27 and 35, 37 provide increased strength and rigidity of the web stiffener 10*c*.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims.

What is claimed is:

1. A web stiffener for use with a building component having a web portion and a leg portion that extends generally outwardly from the web portion, the leg portion having a lip that extends generally upwardly therefrom, the web stiffener comprising:

a first member, comprising:

a web plate having a generally planar surface, said web plate positionable adjacent the web portion of the building component;

a first web support element extending from a first side of said web plate; and a second web support element extending from a second side of said web plate; and a second member extending generally outwardly from said first member, said second member defining a slot to receive the lip of the building component.

2. The web stiffener of claim 1, wherein said first web support element extends generally perpendicularly from said first side of said web plate and said second web support element extends generally perpendicularly from said second side of said web plate.

3. The web stiffener of claim 1, wherein said first web support element and said second web support element each include a proximate end adjacent said second member and a distal end, said distal end including a beveled edge.

4. The web stiffener of claim 1, wherein said first web support element and said second web support element each include an outwardly extending lip.

5. The web stiffener of claim 1, wherein said web plate has at least one aperture extending therethrough.

6. The web stiffener of claim 1, wherein said first member and said second member are integrally formed.

7. The web stiffener of claim 1, wherein a score line is formed between said first member and said second member to enable bending therebetween.

8. The web stiffener of claim 1, wherein said first member is attachable to the web portion of the building component and the second member is attachable to the leg portion of the building component.

9. The assembly of claim 8, further including a second building component, said first building component and said web stiffener attachable to said second building component.

10. A web stiffener for use with a building component having a web portion and a leg portion that extends generally outwardly from the web portion, the leg portion having a lip that extends generally upwardly therefrom, the web stiffener comprising:

a first member; and a second member extending generally outwardly from said first member, said second member defining a slot to receive the lip of the building component, and wherein said second member includes a base plate having an inner base portion and an outer base portion, said inner base portion and said outer base portion defining an elongated portion of said slot.

11. The web stiffener of claim 10, wherein said second member further includes a first base support element extending generally upwardly from said base plate, said first base support element attached to a first end of said inner base portion and a first end of said outer base portion, said first base support element defining a first portion of said slot.

12. The web stiffener of claim 11, wherein said first base support element extends generally perpendicularly from said base plate.

13. The web stiffener of claim 11, wherein said second member further includes a second base support element extending generally upwardly from said base plate, said second base support element attached to a second end of said inner base portion and a second end of said outer base portion, said second base support element defining a second portion of said slot.

14. The web stiffener of claim 13, wherein said second base support element extends generally perpendicularly from said base plate.

15. The web stiffener of claim 13, wherein said first member further comprises:

a web plate;

a first web support element extending from a first side of said web plate; and a second web support element extending from a second side of said web plate, and wherein said first web support element is aligned with said first base support element and said second web support element is aligned with said second base support element.

16. The web stiffener of claim 15, wherein a proximate end of said first web support element is attached to a proximate end of said first base support element and a proximate end of said second web support element is attached to a proximate end of said second base support element.

17. The web stiffener of claim 13, wherein said first base support element and said second base support element each include an outwardly extending lip.

18. The web stiffener of claim 10, wherein said base plate has at least one aperture extending therethrough.

19. A web stiffener for use with a building component having a web portion and a leg portion that extends generally outwardly from the web portion, the leg portion having a lip that extends generally upwardly therefrom, the web stiffener comprising:

a first member; and a second member extending generally outwardly from said first member, said second member defining a slot to receive the lip of the building component, and wherein an oval cutout is formed between said first member and said second member to enable bending therebetween.

20. An assembly, comprising:

a first building component having a web portion and a leg portion that extends generally outwardly from said web portion, said leg portion having a lip that extends generally upwardly therefrom; and a web stiffener comprising;

a first member positionable adjacent said web portion of said first building component, the first member comprising:

a web plate having a generally planar surface, said web plate positionable adjacent the web portion of the building component;

a first web support element extending from a first side of said web plate; and a second web support element extending from a second side of said web plate; and a second member extending generally outwardly from said first member, said second member defining a slot to receive said lip of said first building component.

21. The assembly of claim 20, wherein said first building component is a joist.

22. The assembly of claim 20, wherein said first building component has a generally c-shape cross-section.

23. The assembly of claim 20, wherein said first member of said web stiffener and said web portion of said building component define at least one set of aligned apertures for receipt of a fastener to attach said web stiffener to said first building component.

24. An assembly, comprising:

a first building component having a web portion and a leg portion that extends generally outwardly from said web portion, said leg portion having a lip that extends generally upwardly therefrom; and a web stiffener comprising:

a first member positionable adjacent said web portion of said first building component; and a second member extending generally outwardly from said first member, said second member defining a slot to receive said lip of said first building component, and wherein said second member includes a base plate having an inner base portion and an outer base portion, said inner base and said outer base defining an elongated portion of said slot.

25. The assembly of claim 24, wherein said second member further includes a first base support element extending generally upwardly from, said base plate, said first base support element attached to a first end of said inner base portion and a first end of said outer base portion, said first base support element defining a first portion of said slot.

26. The assembly of claim 25, wherein said second member further includes a second base support element extending generally upwardly from said base plate, said second base support element attached to a second end of said inner base portion and a second end of said outer base portion, said second base support element defining a second portion of said slot.

27. The assembly of claim 26, wherein said inner base of said base plate, said leg portion of said first building component and said second building component define at least one set of aligned apertures for receiving a fastener to attach said web stiffener and said first building component to said second building component.

28. The assembly of claim 26, wherein said outer base of said base plate and said second building component define at least one set of aligned apertures for receiving a fastener for attaching said web stiffener to said second building component.

29. An assembly, comprising:

a first joist having an inner web portion, an outer web portion and a leg portion that extends generally outwardly from said inner web portion, said leg portion having a lip that extends generally upwardly therefrom;

a second joist having an inner web portion, an outer web portion and a leg portion that extends generally outwardly from said inner web portion, said outer web portion of said first joist positionable adjacent said outer web portion of said second joist; and a web stiffener comprising:

a first member positionable adjacent said inner web portion of said first joist; and a second member extending generally outwardly from said first member, said second member defining a slot to receive said lip of said first joist, and wherein said second member includes a base plate having an inner base portion and an outer base portion, said inner base portion and said outer base portion defining an elongated portion of said slot.

30. A method of attaching a first building component and a second building component, the first building component having a web portion and a leg portion that extends generally outwardly from the web portion, the leg portion having a lip that extends generally upwardly therefrom, comprising:

providing a web stiffener having a first member and a second member, the second member extending generally outwardly from said first member and defining a slot and wherein said second member includes a base plate having an inner base portion and an outer base portion, said inner base portion and said outer base portion defining an elongated portion of said slot;

positioning the first member adjacent the web portion of the first building component;

positioning the second member adjacent the leg portion of the first building component and adjacent the second building component such that the lip extending generally upwardly from the leg portion is received in the slot;

attaching the first member to the first building component; and attaching the second member to the first building component and the second building component.

31. An assembly, comprising:

a first joist having an inner web portion, an outer web portion and a leg portion that extends generally outwardly from said inner web portion, said leg portion having a lip that extends generally upwardly therefrom;

a second joist having an inner web portion, an outer web portion and a leg portion that extends generally outwardly from said inner web portion, said outer web portion of said first joist positionable adjacent said outer web portion of said second joist; and a web stiffener comprising:

a first member positionable adjacent said inner web portion of said first joist, the first member comprising:

a web plate having a generally planar surface, said web plate positionable adjacent the web portion of the building component;

a first web support element extending from a first side of said web plate; and a second web support element extending from a second side of said web plate; and a second member extending generally outwardly from said first member, said second member defining a slot to receive said lip of said first joist.

32. A method of attaching a first building component and a second building component, the first building component having a web portion and a leg portion that extends generally outwardly from the web portion, the leg portion having a lip that extends generally upwardly therefrom, comprising:

providing a web stiffener having a first member and a second member, the second member extending generally outwardly from said first member and defining a slot, and the first member comprising:

a web plate having a generally planar surface, said web plate positionable adjacent the web portion of the building component;

a first web support element extending from a first side of said web plate; and a second web support element extending from a second side of said web plate;

positioning the first member adjacent the web portion of the first building component;

positioning the second member adjacent the leg portion of the first building component and adjacent the second building component such that the lip extending generally upwardly from the leg portion is received in the slot;

attaching the first member to the first building component; and attaching the second member to the first building component and the second building component.

* * * * *

UNITED STATES PATENT AND TRADEMARK OFFICE

CERTIFICATE OF CORRECTION

PATENT NO. : 6,430,890 B1
DATED : August 13, 2002
INVENTOR(S) : Chiwhane et al.

It is certified that error appears in the above-identified patent and that said Letters Patent is hereby corrected as shown below:

Column 6,
Line 18, delete “end 22” and insert -- end 23 -- therefor.
Line 20, delete “10c” and insert -- 10b -- therefor.

Signed and Sealed this

Seventh Day of January, 2003

JAMES E. ROGAN
*Director of the United States Patent and Trademark Office*